US006578404B1

(12) United States Patent
Rousseau

(10) Patent No.: US 6,578,404 B1
(45) Date of Patent: Jun. 17, 2003

(54) AUTO BODY CRIMPING TOOL

(76) Inventor: Tod O. Rousseau, 927 Depot St., Sparta, WI (US) 54656

( * ) Notice: Subject to any disclaimer, the term of this patent is extended or adjusted under 35 U.S.C. 154(b) by 0 days.

(21) Appl. No.: 10/010,198

(22) Filed: Dec. 5, 2001

Related U.S. Application Data

(60) Provisional application No. 60/251,279, filed on Dec. 6, 2000.

(51) Int. Cl.[7] ..... B21D 5/16; B21D 39/02

(52) U.S. Cl. ..... 72/413; 72/453.16; 29/243.58

(58) Field of Search ..... 72/412, 413, 453.16, 72/453.15; 29/243.58, 243.57, 243.5

(56) References Cited

U.S. PATENT DOCUMENTS

| | | | | | |
|---|---|---|---|---|---|
| 421,187 | A | | 2/1890 | Myers | |
| 2,143,339 | A | | 1/1939 | Wiese | |
| 2,810,420 | A | * | 10/1957 | Gibson | 72/479 |
| 3,123,124 | A | * | 3/1964 | Armitage | 72/453.16 |
| 3,166,961 | A | | 1/1965 | Chaplin, Sr. | |
| 3,180,128 | A | | 4/1965 | Faulkner | |
| 3,213,817 | A | * | 10/1965 | Hunziker | 29/243.57 |
| 3,421,356 | A | | 1/1969 | Buske | |
| 3,477,272 | A | | 11/1969 | Hunter | |
| 3,602,032 | A | | 8/1971 | Skintzis | |
| 3,777,687 | A | * | 12/1973 | Colman, Jr. | 29/243.58 |
| 3,877,286 | A | * | 4/1975 | Fontaine et al. | 72/453.16 |
| 3,961,518 | A | | 6/1976 | Osbolt | |
| 3,987,740 | A | * | 10/1976 | Merson | 29/243.58 |
| 4,060,046 | A | * | 11/1977 | Eckold et al. | 29/243.58 |
| 4,145,907 | A | | 3/1979 | Barber et al. | |
| 4,318,211 | A | | 3/1982 | Hoskinson | |
| 4,372,022 | A | * | 2/1983 | Puckett | 29/243.58 |
| 4,517,724 | A | | 5/1985 | Gee | |
| 4,713,959 | A | | 12/1987 | Bennett | |
| 4,825,676 | A | | 5/1989 | Diggins | |
| 4,827,595 | A | | 5/1989 | Dacey, Jr. | |
| 5,090,101 | A | | 2/1992 | Welty | |
| 5,095,732 | A | | 3/1992 | Bootka | |
| 5,875,670 | A | * | 3/1999 | Stojkovski et al. | 29/243.58 |
| 5,878,617 | A | | 3/1999 | Parker | |
| 5,940,950 | A | * | 8/1999 | Galat | 29/243.58 |
| 6,038,753 | A | * | 3/2000 | Willett | 29/243.58 |

* cited by examiner

*Primary Examiner*—Daniel C. Crane
(74) *Attorney, Agent, or Firm*—Tipton L. Randall

(57) ABSTRACT

A tool for crimping a flanged vehicle door panel onto a door frame includes a pneumatic power unit that attaches to a crimping head unit. The head unit includes a rectangular housing with a circular aperture for attachment of a crimping head member. The rectangular housing also has an attached anvil portion that includes a central channel for holding a nylon pad. The crimping head member mounts above the anvil and nylon pad with a small amount of clearance there between. The head member has a leading edge that curves upwardly away from the nylon pad. In operation, the flanged door panel is positioned so the flange extends upwardly from the frame. The user moves the tool along the edge of the door frame with the crimping head member moving in a limited arc to incrementally crimp the flange tightly against the frame supported on the nylon pad as the tool moves along the edge of the work piece.

15 Claims, 7 Drawing Sheets

FIG. 11
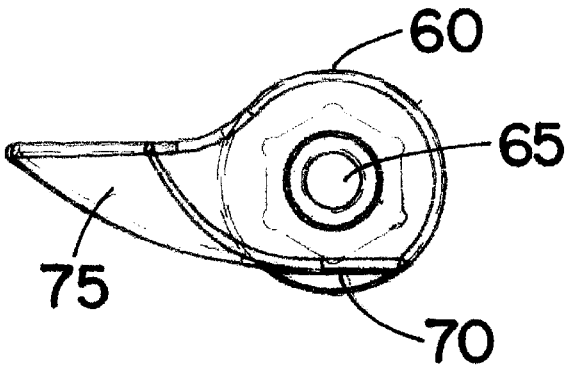
FIG. 12
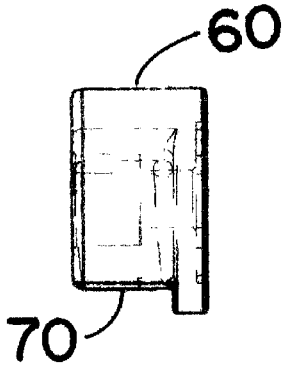
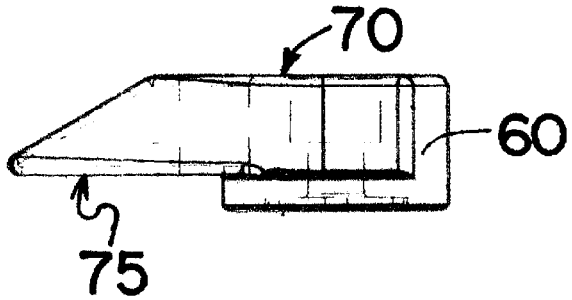
FIG. 13
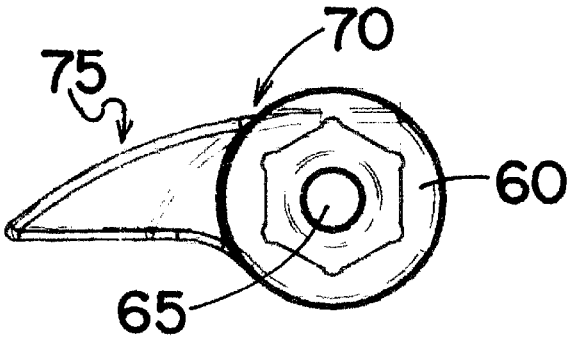
FIG. 14

AUTO BODY CRIMPING TOOL

CROSS REFERENCE TO RELATED APPLICATION

This application claims the benefit under 35 U.S.C. §119 (e) of now abandoned provisional application Serial No. 60/251,279, filed Dec. 6, 2000. Application Serial No. 60/251,279 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

FIELD OF THE INVENTION

The present invention relates to an auto body tool and, more particularly, to a powered crimping tool for folding the flange of an automobile replacement door skin panel to an existing door shell.

BACKGROUND OF THE INVENTION

This invention relates to crimping tools and, more particularly, to a powered crimping tool for folding the flange of an automobile replacement door skin panel to an existing door shell as well as for crimping other irregularly shaped parts.

Every aspect of sheet metal work requires a relatively large amount of crimping operations. Sheet metal parts are crimped to increase their strength, to fasten a plurality of sheet metal parts to each other, or to prepare them for subsequent welding, and to enhance the appearance of the parts. Most crimping operations are performed in a workshop or a factory where the final part is being manufactured. Usually there are relatively large and expensive machines available that rapidly crimp long sections. These machines are also capable of crimping irregularly shaped sheet metal edges as long as it is economically feasible to adapt a relatively expensive machine to such a task.

A problem was encountered when a crimping operation had to be performed without the help of such machines. This is frequently the case where a last crimp has to be made upon installation of a part or where an already installed part has to be repaired. In those instances, the machines found in workshops and factories are not available or, due to their bulkiness, cannot be employed. The crimping operation then had to be performed by hand. This is done by supporting the part to be crimped with a block, such as a steel block, having a relatively large mass and manually hammering the other side of the sheet metal to deform and crimp it. Automobile repair work, and particularly the installation of door panels after the original door panel had been damaged in an accident, are recurring examples of such work.

A crimping operation performed in this manner is time-consuming and, therefore, uneconomical. Moreover, the final appearance of the crimped part is not always satisfactory since the workman has relatively little control when striking the sheet metal part with a hammer. This is particularly true when there is limited access for striking the part with the hammer.

Since a relatively large space is required for swinging the hammer, parts must often be disassembled to give the workman access for striking his hammer. Again, an example of this is the door of an automobile that receives a new outside door panel. The edge of the door adjacent the door hinges cannot be reached with a manual hammer. In order to crimp this edge the door has to be removed from its hinges, which involves additional and time-consuming labor. Modern cars have a variety of electrical equipment in the door, such as cigarette lighters, power-operated windows, locks, seats, and mirrors which must be electrically disconnected first. To make the disconnections, the inside panel of the door must be taken off, which includes all handles, switches and armrests. After the door has thus been disassembled, removed, and the outside panel crimped thereto, all parts have to be assembled again and the door installed thereafter.

Large amounts of labor, which is the most expensive part in automobile repair work, have to be expended in order to attach a new outside door panel to the door. All this labor was necessary only because crimping tools that were capable of reaching areas that could not be reached by a manual hammer used for crimping a part were not available in the past.

Various devices for use in fastening or crimping one piece of sheet metal to another have been granted patents. Myers, in U.S. Pat. No. 421,187, describes a double handled device with a pair of mating jaws that crimp together the edges of two pieces of sheet metal or roofing.

In U.S. Pat. No. 2,143,339, Wiese discloses a roof seaming tool that has a plyers-like head with an overlapping jaw portion for grasping and crimping two sheet metal pieces together.

Chaplin, Sr., in U.S. Pat. No. 3,166,961, describes a sheet metal roofing fastener bender tool that includes a handle section with a semicircular head that crimps a nail or similar fastener around an I-beam or C-channel support.

In U.S. Pat. No. 3,180,128, Faulkner discloses a lever operated crimping tool with a biasing spring to hold the crimping rod away from the handle. Only a small area can be crimped at one time.

Buske, in U.S. Pat. No. 3,421,356, describes another panel crimping tool that attaches to an air hammer. The tool includes a flat anvil and a hammer head, pivoted to the tool frame, which is driven by the piston rod of the air hammer.

In U.S. Pat. No. 3,477,272, Hunter discloses yet another panel crimping tool that attaches to an air hammer. The tool has an interchangeable anvil and a pivoted hammer head which is driven via a rod member, within a handle portion, by the air hammer.

In U.S. Pat. No. 3,602,032, Skintzis discloses a pneumatic hammer with a crimping jaw head designed for attaching a replacement panel over a damaged door of an automobile. The head has a pivoting jaw that applies force against an opposed support surface to crimp the free end of a flange about a door panel. The moving jaw is small in order to apply the replacement panel with the door attached to the automobile.

Osbolt, in U.S. Pat. No. 3,961,518, describes a hand operated crimping device for attaching a replacement panel over a damaged door of an automobile. The device includes a flat anvil jaw portion and an L-shaped crimping member that presses the free end of a flange against a door panel. Again, the crimping member is quite small in the area that contacts the flange.

Barber et al., in U.S. Pat. No. 4,145,907, disclose a metal edge turning power tool. The bending portion of the device attaches to a standard reciprocating jig saw and includes two blade members. One blade member rests against the sheet metal while the other blade member moves reciprocally to bend the edge of a horizontal piece of sheet metal vertically.

U.S. Pat. No. 4,318,211, by Hoskinson discloses a crimping tool for automobile door panels. The hand operated tool has a pair of levers pivoted to one another with the pivoted ends defining the holding and crimping jaws. The jaws press the free end of a flange against a door panel. Again, the crimping member is quite small in the area that contacts the flange.

In U.S. Pat. No. 4,517,724, Gee discloses a seaming tool for air ducts where one panel forms a bent flange and another flange forms a flange receiving channel. The tool aligns the two panels and drives the flange into the channel when struck with a hammer or similar item.

U.S. Pat. No. 4,713,959 by Bennett describes a tool for coupling sections of air handling ducts. The plyers-like device has jaws that are specially formed to connect, bend over and collapse the peripheral lips of the duct sections. The sequence of steps is shown in FIGS. 2–5.

In U.S. Pat. No. 4,825,676, Diggins discloses a flange rolling hand tool that deforms the edge of a metal sheet to provide a flange or edge portion, which is offset from the plane of the sheet. The plyers-like device has two opposed rollers that crimp the edge of the sheet metal.

Dacey, Jr., in U.S. Pat. No. 4,827,595, describes a single station hemming device for fabricating auto body parts. The device has a series of hemming tools positioned around the periphery of the two pieces to be joined together. The station laps one edge over the other of the two parts and crimps them together. The station is specific for each part of an auto, such as a hood or trunk cover.

U.S. Pat. No. 5,090,101 by Welty discloses a hand-held pneumatic tool for installing the corners of transverse duct systems. The tool has a pivoting jaw that moves toward a stationary jaw to crimp two duct flanges together.

In U.S. Pat. No. 5,095,732, Bootka discloses another plyers-like tool for manually crimping a flanged vehicle door panel onto a door frame without the need to remove the door from the vehicle body. The jaws move in a pincher-like fashion to crimp the flange flat.

Parker, in U.S. Pat. No. 5,878,617, describes a pneumatic decking crimper for fastening and dimpling structural steel decking and roofing panels together. The jaws move in a pincher-like fashion to fasten the male and female lips of the decking together.

Applicant has invented a powered crimping tool for folding the flange of an automobile replacement door skin panel to an existing door shell. Other features and advantages of the present invention will become apparent from the following description of the a double clip device.

SUMMARY OF THE INVENTION

The present invention is a tool for crimping a flanged vehicle door panel onto a door frame. The auto body crimping tool assembly includes a hollow housing body member with a first aperture centered on a body member first axis at one end thereof. The body member also includes a second aperture centered on a body member second axis perpendicular to the first axis. The housing body member includes an offset anvil bed member adjacent the body member second aperture with a flat surface aligned with the body member first axis. A nylon pad is adjustably secured to the anvil bed member. A crimping head member is pivotally mounted near an end thereof on a drive shaft member rotatably secured in the body member second aperture with the crimping head member positioned a selected distance above the nylon pad and anvil bed member. The crimping head member has a flat crimping surface facing the nylon pad and anvil bed member adjacent the pivotally mounted end thereof and a helical crimping surface facing the nylon pad and anvil bed member opposite the pivotally mounted end thereof, with the helical crimping surface inclined away from the housing body member. A power source positioned at the body member first aperture is operably connected to the drive shaft member and imparts reciprocal rotary motion to the drive shaft, causing the flat and helical crimping surfaces of the crimping head member to pivot away from and toward the nylon pad and anvil bed member, thereby crimping a replacement door skin panel to a door shell as the edges of the panel and shell move between the crimping head member and nylon pad and anvil bed member.

In operation, the flanged door panel is positioned so the flange extends upwardly from the frame. The user moves the tool along the edge of the door frame with the crimping head member moving in a limited arc to incrementally crimp the flange tightly against the frame as the tool moves along the edge of the work piece. The crimped flange and door frame pass between the crimping head member and the nylon pad and anvil member. The nylon pad contacts the exterior of the door panel to prevent damage or scuffing of the panel surface that is normally exposed on the exterior of the automobile.

BRIEF DESCRIPTION OF THE DRAWINGS

FIG. 11 is a plan side view of the crimping head member of the present invention.

FIG. 12 is an end view of the crimping head member of the present invention.

FIG. 13 is a top view of the crimping head member of the present invention.

FIG. 14 is another plan side view of the crimping head member of the present invention.

Figure 1:
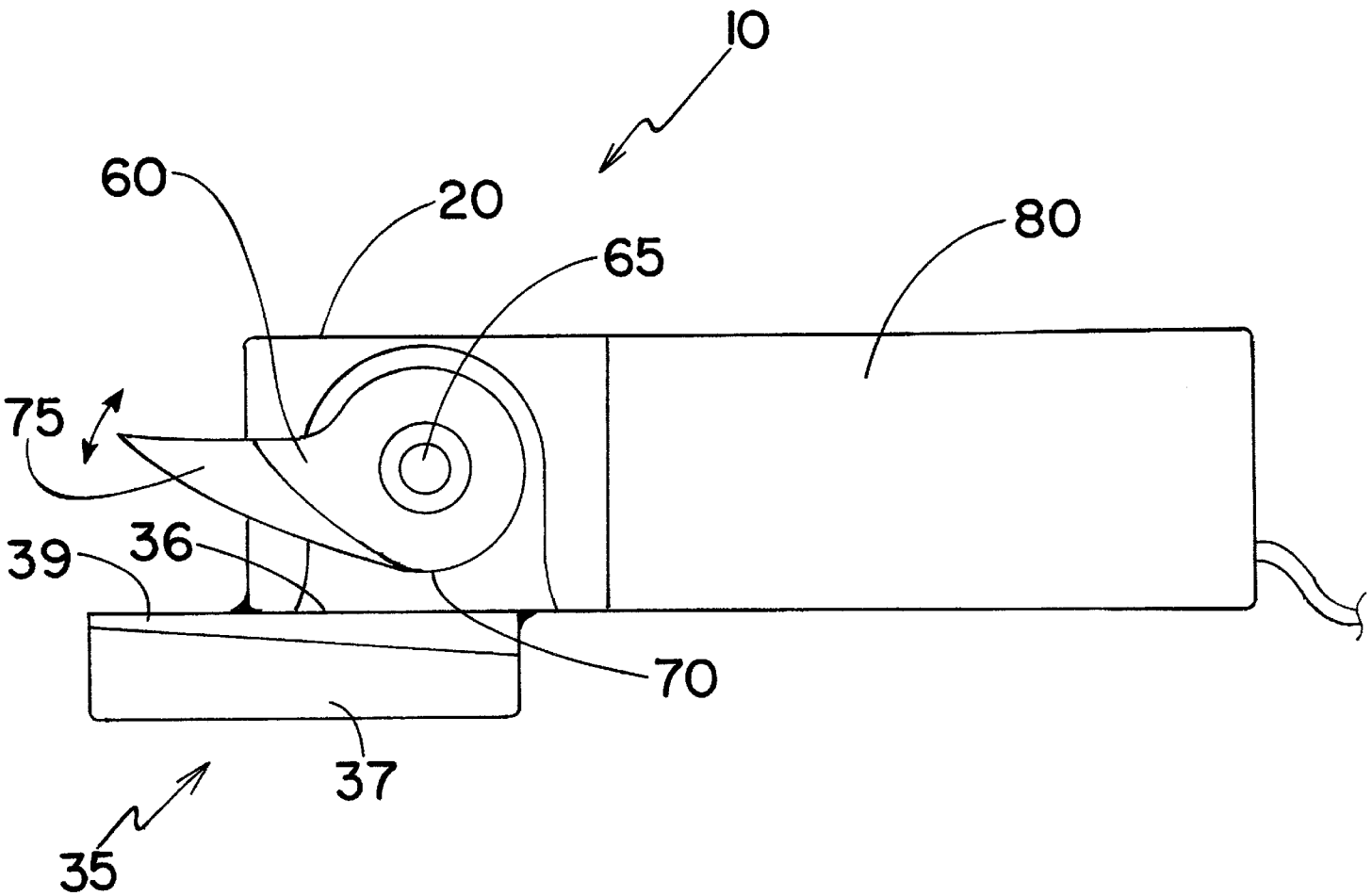
FIG. 1 is a plan side view of the crimping tool assembly of the present invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Nomenclature

Figure 2:
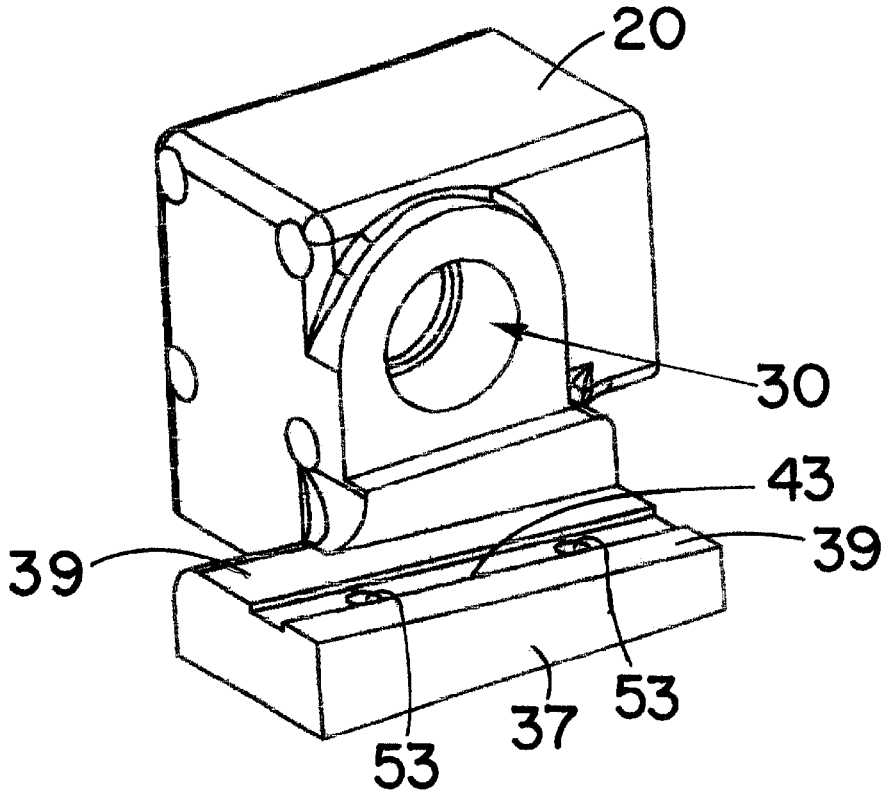
FIG. 2 is a perspective view of the housing body and anvil bed member of the present invention.
Figure 3:
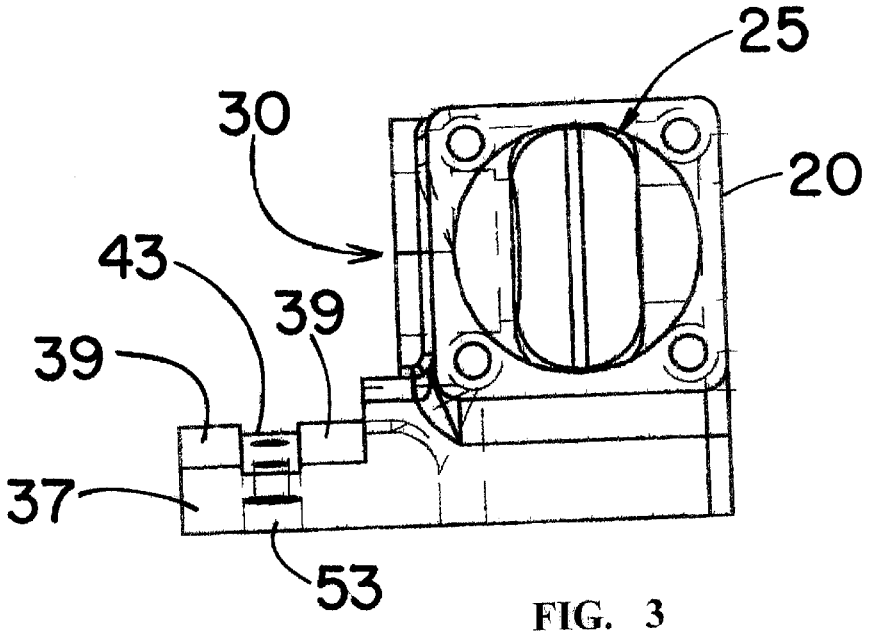
FIG. 3 is an end view of the housing body and anvil bed member of the present invention.
Figure 4:
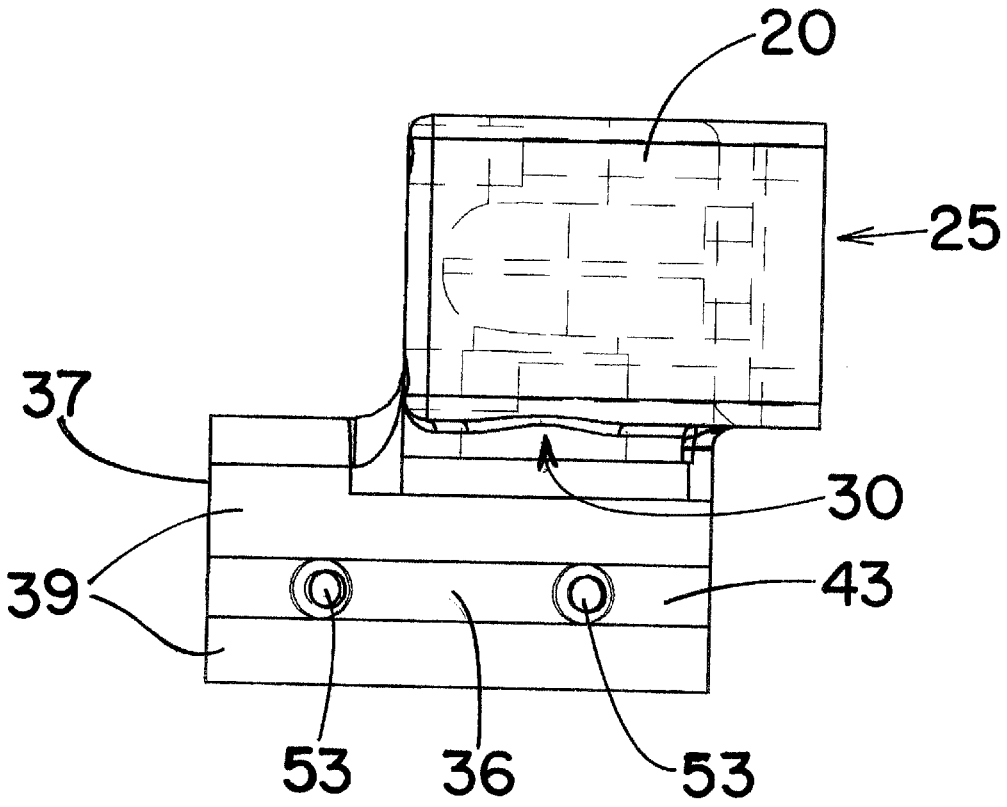
FIG. 4 is a top view of the housing body and anvil bed member of the present invention.
Figure 7:
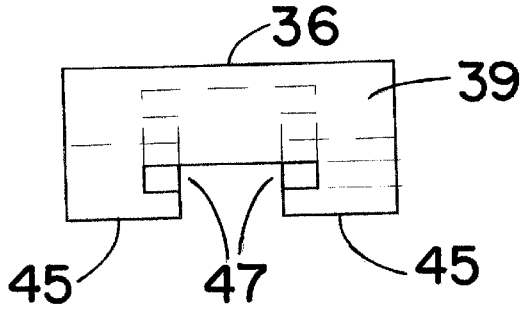
FIG. 7 is an end view of the nylon pad portion of the present invention.

10 Crimping Tool Assembly
20 Hollow Housing Body Member
25 First Aperture in Body Member
30 Second Aperture in Body Member
35 Offset Anvil Bed Member
36 Flat Surface of Anvil Bed Member
37 Portion of Anvil Bed Member
39 Adjustable Pad Portion of Anvil Bed Member
41 Inclined Upper Surface of Base Portion
43 Linear Slot in Base Portion Upper Surface
45 Inclined Lower Surface of Pad Portion
47 T-Shaped Linear Slot in Pad Portion Lower Surface
49 T-Shaped Clamp of Pad Portion
51 Threaded Apertures of T-Shaped Clamp
53 Apertures in Central Slot of Base Portion
55 Threaded Fasteners
60 Crimping Head Member
65 Drive Shaft of Crimping Head Member
70 Flat Crimping Surface of Head Member
75 Helical Crimping Surface of Head Member
80 Pneumatic Power Source
100 Crimping Tool and Power Source Assembly
A Compressed Air Supply Line Construction Referring to FIGS. 1–4, one embodiment of the auto body crimping tool assembly 10 is shown. The crimping tool assembly 10 includes a hollow housing body member 20 with a first aperture 25 centered on a body member first axis at one end thereof, as seen in FIG. 3. The hollow body member 20 also contain a second aperture 30 centered on a body member second axis perpendicular to the first axis, as seen in FIG. 2. A drive shaft member 65 secured by a bearing (not shown) in the second aperture 30 supports and powers a crimping head member 60 having a flat crimping surface 70 and a helical crimping surface 75 there upon. The crimping head member 60 is described in detail below.

Figure 5:
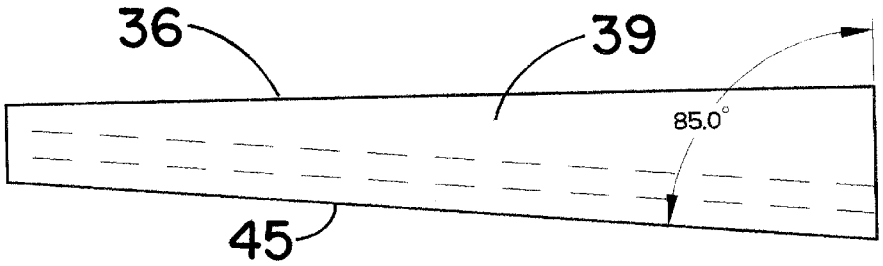
FIG. 5 is a plan side view of the nylon pad portion of the present invention.
Figure 6:
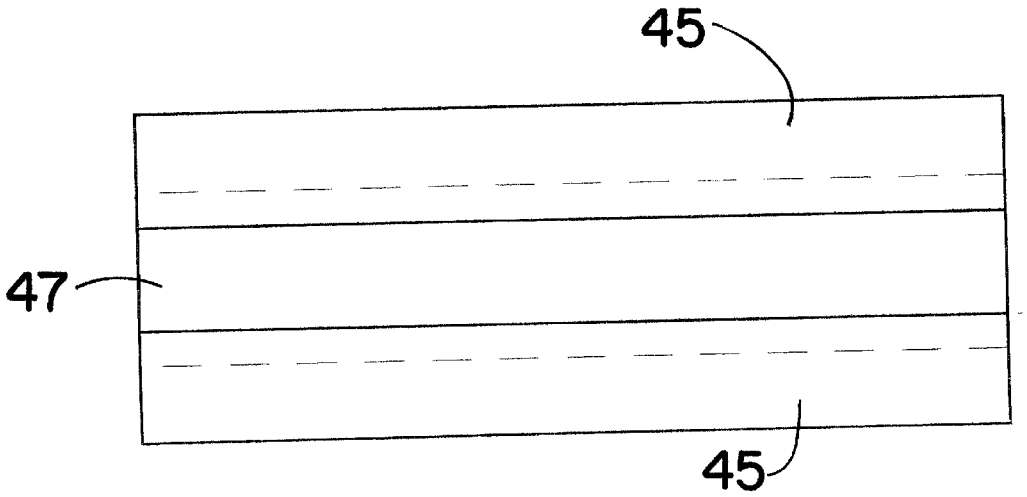
FIG. 6 is a bottom view of the nylon pad portion of the present invention.

The housing hollow body member 20 includes an offset anvil bed member 35 adjacent the body member second aperture 30 with a flat surface 36 aligned with the body member first axis and in opposition to the crimping surfaces 70, 75 of the crimping head member 60. The anvil bed member 35 includes a rigid base portion 37 opposite the crimping head member 60, and an adjustable pad portion 39 facing the crimping head member 60. The anvil base portion 37 has an inclined upper surface 41 facing the crimping head member 60, the anvil base portion 37 increasing in thickness with distance from the crimping head member flat crimping surface 70. The base portion upper surface 41 includes a linear fastening slot 43 for securing the adjustable pad portion 39 thereto, as seen in FIG. 2. The pad portion 39 has an inclined lower surface 45 facing the anvil base portion inclined upper surface 41, the pad portion 39 decreasing in thickness with distance from the crimping head member flat crimping surface 70. The pad portion lower surface 45 includes a T-shaped linear slot 47 therein, the slot 47 including a horizontal slot portion and vertical slot portion that faces the base portion fastening slot 43, the T-shaped slot 47 extending the full length of the pad portion 39, as seen in FIG. 5.

Figure 10:
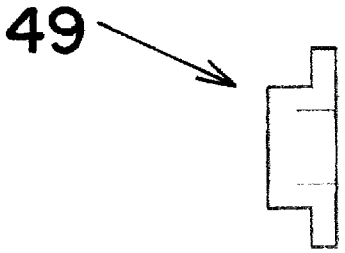
FIG. 10 is an end view of the clamp of the present invention.
Figure 9:
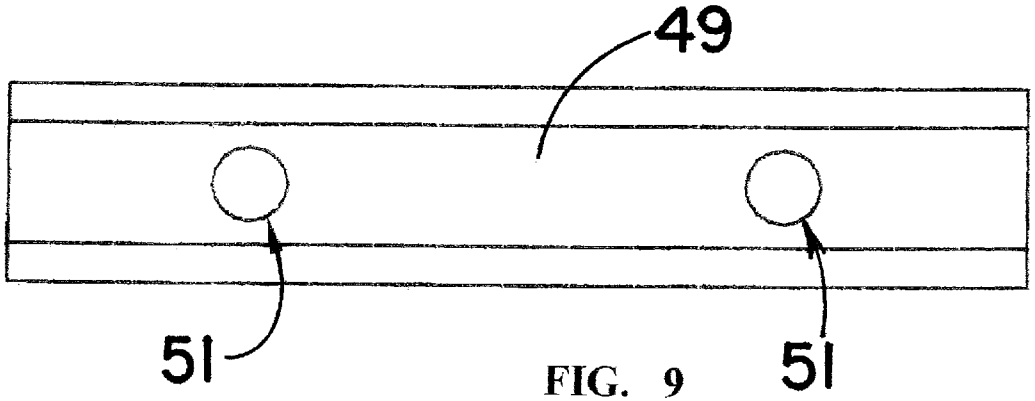
FIG. 9 is a bottom view of the clamp of the present invention.
Figure 8:
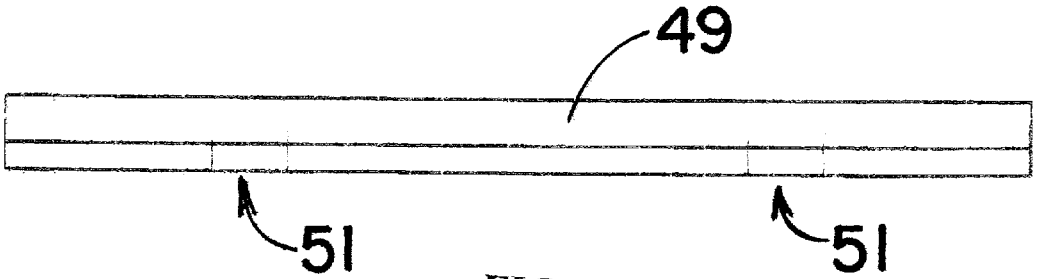
FIG. 8 is a plan side view of the clamp of the present invention.

Referring now to FIGS. 8–10, a linear T-shaped clamp member 49, having horizontal and vertical leg portions, is slidably positioned in the T-shaped linear slot 47 and used for adjustably securing the pad portion 39 to the anvil base portion 37. The anvil base portion 37 includes at least two spaced apart apertures 53 extending from the linear slot 43 through the bottom side of the anvil base portion 37. A similar number of spaced apart threaded apertures 51 are located in the vertical leg portion of the T-shaped clamp 49 so that threaded fasteners 55 inserted through apertures 53 and into threaded apertures 51 secure the anvil base portion 37 and pad portion 39 together. The horizontal leg portions of the T-shaped clamp member 49 press the inclined lower surface 45 of the pad portion 39 against the inclined upper surface 41 of the anvil base portion 37 as the threaded fasteners 55 are tightened. The adjoining inclined surfaces 41, 45 provide spacing adjustment between the pad member upper surface 36 and the crimping head member 60. As the inclined surface 41 of the pad portion 39 moves down the inclined surface 45 of the base portion 37, the distance between the upper pad surface 36 and the crimping head member 60 increases. Thus, work pieces of varying size can be accommodated between the crimping head member 60 and the pad portion 39 of the anvil bed member 35.

Referring now to FIGS. 11–14, the crimping head member 60 is pivotally mounted near an end thereof on a drive shaft member 65 that is rotatably secured in the body member second aperture 30 by a bearing (not shown). The crimping head member 60 is positioned a selected distance above the anvil bed member 35, with the crimping head member 60 having a flat crimping surface 70 facing the anvil bed member 35 adjacent the pivotally mounted end thereof, and a helical crimping surface 75 facing the anvil bed member 35 opposite the pivotally mounted end thereof. The helical crimping surface 75 is inclined away from the housing body member 20, as seen in FIG. 1.

A power source, such as a pneumatically powered motor 80 supplied with compressed air from a supply line A, is positioned at the body member first aperture 25 and operably connected to the drive shaft member 65 to impart reciprocal rotary motion to the drive shaft member 65, thereby causing the flat and helical crimping surfaces 70, 75 of the crimping head member 60 to pivot toward and away from the anvil bed member 35. The up and down movement of the crimping head member 60 is through an arc of about 5 degrees.

In one embodiment of the invention, the drive shaft member 65 includes a yoke member secured to the drive shaft member 65 and positioned within the hollow housing member 20. The power source 80 includes a shaft with an eccentric member attached thereto, with the eccentric member positioned within the yoke member which is secured to the drive shaft member 65. Rotation of the eccentric member within the yoke member produces reciprocating rotary motion of the drive shaft member 65, causing the flat and helical crimping surfaces 70, 75 of the crimping head member 60 to pivot toward and away from the anvil bed member 35.

Figure 15:
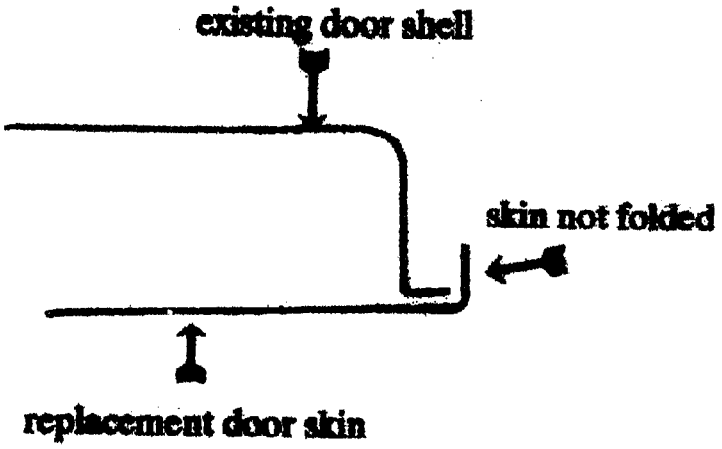
FIG. 15 is a cross sectional view of a replacement door panel and door shell before crimping.
Figure 16:
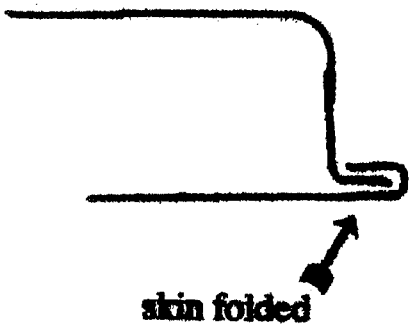
FIG. 16 is a cross sectional view of a replacement door panel and door shell after crimping.

In use, a replacement door panel or "skin" is supported horizontally with the exterior of the door panel facing down and the perpendicular panel flange pointing vertically upward, as seen in FIG. 15. The existing door shell is placed atop the supported door panel with the horizontal door shell edge adjacent the panel vertical flange. The worker grasps the power source member 80 and, starting at one panel edge end and moving parallel to the panel edge, contacts the exterior of the door panel with the pad portion 39 of the anvil bed member 35. The helical crimping surface 70 of the crimping head member 60 first contacts the panel vertical flange to begin the crimping process by bending the vertical flange away from the housing member 20 ands toward the door shell. As the crimping head member 60 reciprocally rotates through about a 5 degree arc, each movement of the crimping head member 60 toward the anvil bed member 35 produces incremental crimping of the panel vertical flange toward the door shell edge. Each movement of the crimping head member 60 away from the anvil bed member 35 allows the crimping tool assembly 10 to move along the work piece, toward the uncrimped portion of the panel vertical flange. The point of contact for a given location of the panel vertical flange moves along the helical crimping surface 75 toward the flat crimping surface 70 of the crimping head member 60, and finally between the flat crimping surface 70 thereof and the anvil bed member 35, thereby crimping a replacement door panel to a door shell as the edges of the panel and shell move there between, as seen in FIG. 16. The pad portion 39 of the anvil bed member 35 is preferably fabricated from nylon polymer for strength and durability, and to prevent marring or scratching of the door panel exterior surface secured to the door shell.

The invention has been described with reference to various specific and preferred embodiments and techniques. However, it should be understood that many variations and modifications may be made while remaining within the spirit and scope of the invention.

What is claimed is:

1. An auto body crimping tool assembly comprising:

(a) a hollow housing body member with a first aperture centered on a body member first axis at one end thereof, the body member containing a second aperture centered on a body member second axis perpendicular to the first axis, the housing body member including an offset anvil bed member adjacent the body member second aperture with a flat surface aligned with the body member first axis, the anvil bed member including a base portion rigidly secured to the body member opposite the crimping head member and a pad portion adjustably secured to the base portion, the pad portion facing the crimping head member; and (b) a crimping head member pivotally mounted near an end thereof on a drive shaft member rotatably secured in the body member second aperture, the crimping head member positioned a selected distance above the anvil bed member, the crimping head member having a flat crimping surface facing the anvil bed member adjacent the pivotally mounted end thereof and a helical crimping surface facing the anvil bed member opposite the pivotally mounted end thereof, the helical crimping surface inclined away from the housing body member, whereby a power source positioned at the body member first aperture and operably connected to the drive shaft member imparts reciprocal rotary motion to the drive shaft, causing the flat and helical crimping surfaces of the crimping head member to reciprocally pivot toward and away from the anvil bed member, thereby incrementally crimping a replacement door skin panel to a door shell as the edges of the panel and shell move between the crimping head member and anvil bed member.

2. An auto body crimping tool assembly according to claim 1 wherein the anvil bed base portion includes a linear fastening slot facing the pad portion and the pad portion includes a linear T-shaped slot, including horizontal and vertical slot portions, the vertical slot portion facing the base portion linear fastening slot, a linear T-shaped clamp member, including horizontal and vertical leg portions, said clamp member moveably positioned in the pad portion T-shaped slot, the clamp member vertical leg portion sized to fit the base portion fastening slot, and fastening means for securing the T-shaped clamp member in the base portion fastening slot.

3. An auto body crimping tool assembly according to claim 1 wherein the anvil bed member base portion increases in thickness with distance from the crimping head member flat crimping surface and the pad portion decreases in thickness with distance from the crimping head member flat crimping surface.

4. An auto body crimping tool assembly according to claim 1 wherein the anvil pad portion is fabricated from a polymeric resin material.

5. An auto body crimping tool assembly according to claim 1 wherein the anvil pad portion is fabricated from nylon.

6. An auto body crimping tool assembly comprising:

(a) a hollow housing body member with a first aperture centered on a body member first axis at one end thereof, the body member containing a second aperture centered on a body member second axis perpendicular to the first axis, the housing body member including an offset anvil bed member adjacent the body member second aperture with a flat surface aligned with the body member first axis, the anvil bed member including a base portion rigidly secured to the body member opposite the body member second aperture and a pad portion adjustably secured to the base portion, the pad member facing the body member second aperture; and (b) a crimping head member pivotally mounted near an end thereof on a drive shaft member rotatably secured in the body member second aperture, the crimping head member positioned a selected distance above the anvil bed member, the crimping head member having a flat crimping surface facing the anvil bed member pad portion adjacent the pivotally mounted end thereof and a helical crimping surface facing the anvil bed member pad portion opposite the pivotally mounted end thereof, the helical crimping surface inclined away from the housing body member, whereby a power source positioned at the body member first aperture and operably connected to the drive shaft member imparts reciprocal rotary motion to the drive shaft, causing the flat and helical crimping surfaces of the crimping head member to reciprocally pivot toward and away from the anvil bed member pad portion, thereby incrementally crimping a replacement door skin panel to a door shell as the edges of the panel and shell move between the crimping head member and anvil bed member pad portion.

7. An auto body crimping tool assembly according to claim 6 wherein the anvil bed base portion includes a linear fastening slot facing the pad portion and the pad portion includes a linear T-shaped slot, including horizontal and vertical slot portions, the vertical slot portion facing the base portion linear fastening slot, a linear T-shaped clamp member, including horizontal and vertical leg portions, said clamp member moveably positioned in the pad portion T-shaped slot, the clamp member vertical leg portion sized to fit the base portion fastening slot, and fastening means for securing the T-shaped clamp member in the base portion fastening slot.

8. An auto body crimping tool assembly according to claim 6 wherein the anvil bed member base portion increases in thickness with distance from the crimping head member flat crimping surface and the pad portion decreases in thickness with distance from the crimping head member flat crimping surface.

9. An auto body crimping tool assembly according to claim 6 wherein the anvil pad portion is fabricated from a polymeric resin material.

10. An auto body crimping tool assembly according to claim 9 wherein the anvil pad portion is fabricated from nylon.

11. An auto body crimping tool and power source assembly comprising:

(a) a hollow housing body member with a first aperture centered on a body member first axis at one end thereof, the body member containing a second aperture centered on a body member second axis perpendicular to the first axis, the housing body member including an offset anvil bed member adjacent the body member second aperture with a flat surface aligned with the body member first axis, the anvil bed member including a base portion rigidly secured to the body member opposite the crimping head member and a pad portion adjustably secured to the base portion, the pad portion facing the crimping head member;

(b) a crimping head member pivotally mounted near an end thereof on a drive shaft member rotatably secured in the body member second aperture, the crimping head member positioned a selected distance above the anvil bed member, the crimping head member having a flat crimping surface facing the anvil bed member adjacent the pivotally mounted end thereof and a helical crimping surface facing the anvil bed member opposite the pivotally mounted end thereof, the helical crimping surface inclined away from the housing body member; and (c) a power source positioned and secured at the body member first aperture, the power source operably connected to the drive shaft member and imparting reciprocal rotary motion to the drive shaft, causing the flat and helical crimping surfaces of the crimping head member to reciprocally pivot toward and away from the anvil bed member, thereby incrementally crimping a replacement door skin panel to a door shell as the edges of the panel and shell move between the crimping head member and anvil bed member.

12. The auto body crimping tool and power source assembly according to claim 11 wherein the power source is a pneumatically powered motor.

13. An auto body crimping tool assembly according to claim 11 wherein the anvil bed base portion includes a linear fastening slot facing the pad portion and the pad portion includes a linear T-shaped slot, including horizontal and vertical slot portions, the vertical slot portion facing the base portion linear fastening slot, a linear T-shaped clamp member, including horizontal and vertical leg portions, said clamp member moveably positioned in the pad portion T-shaped slot, the clamp member vertical leg portion sized to fit the base portion fastening slot, and fastening means for securing the T-shaped clamp member in the base portion fastening slot.

14. An auto body crimping tool assembly according to claim 11 wherein the anvil bed member base portion increases in thickness with distance from the crimping head member flat crimping surface and the pad portion decreases in thickness with distance from the crimping head member flat crimping surface.

15. An auto body crimping tool assembly according to claim 11 wherein the anvil pad portion is fabricated from nylon.

* * * * *